US008820466B2

(12) United States Patent
Fujita et al.

(10) Patent No.: US 8,820,466 B2
(45) Date of Patent: Sep. 2, 2014

(54) WORKING MACHINE

(71) Applicant: Kubota Corporation, Osaka (JP)

(72) Inventors: Yuji Fujita, Sakai (JP); Masamitsu Date, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 13/959,016

(22) Filed: Aug. 5, 2013

(65) Prior Publication Data

US 2014/0034408 A1 Feb. 6, 2014

(30) Foreign Application Priority Data

Aug. 6, 2012 (JP) ..... 2012-174122

(51) Int. Cl.
*B60K 1/00* (2006.01)
*E02F 9/08* (2006.01)
*E02F 9/20* (2006.01)

(52) U.S. Cl.
CPC ..... *E02F 9/20* (2013.01); *E02F 9/0891* (2013.01); *E02F 9/0866* (2013.01)
USPC ..... 180/291

(58) Field of Classification Search
USPC ..... 180/65.1–65.31, 291; 903/902–907
See application file for complete search history.

(56) References Cited

U.S. PATENT DOCUMENTS

| | | | | |
|---|---|---|---|---|
| RE37,798 | E * | 7/2002 | Uchiyama et al. | 123/90.31 |
| 6,820,356 | B2 * | 11/2004 | Naruse et al. | 37/348 |
| 7,013,646 | B1 * | 3/2006 | Serkh et al. | 60/698 |
| 7,717,218 | B2 * | 5/2010 | Matsumoto et al. | 180/291 |
| 8,365,855 | B2 * | 2/2013 | Mamada et al. | 180/68.1 |
| 8,384,327 | B2 * | 2/2013 | Takahashi | 318/400.3 |
| 2006/0226680 | A1 * | 10/2006 | Matsumoto et al. | 296/190.01 |
| 2010/0283256 | A1 * | 11/2010 | Bianchi | 290/1 A |
| 2012/0330597 | A1 * | 12/2012 | Lammers | 702/122 |
| 2013/0074410 | A1 * | 3/2013 | Berkeland | 49/142 |

FOREIGN PATENT DOCUMENTS

| | | |
|---|---|---|
| JP | 2001-220771 A | 8/2001 |
| JP | 2008-31937 A | 2/2008 |

* cited by examiner

*Primary Examiner* — John Walters
*Assistant Examiner* — James Triggs
(74) *Attorney, Agent, or Firm* — Birch, Stewart, Kolasch & Birch, LLP

(57) ABSTRACT

To provide a working machine of which a compressor and an alternator are accessible from a back side of an engine hood. On a machine body, a motor is mounted such that a shaft center of an output shaft thereof coincides with a lateral direction of the machine body; an engine hood covering the motor is provided with an open/close cover that can open the inside of the engine hood backward; on a lateral surface of the motor on an output shaft side, a compressor bracket attached with a compressor at a position behind the output shaft of the motor is attached and fixed; and an alternator that is positioned behind the output shaft of the motor and vertically displaced in position from the compressor is provided.

6 Claims, 13 Drawing Sheets

WORKING MACHINE

TECHNICAL FIELD

The present invention relates to a working machine in which on a lateral side of a motor (driving source) such as an engine, or an electric motor, a compressor and an alternator are arranged.

BACKGROUND ART

Examples of arranging a compressor and an alternator near a motor of a working machine include an invention described in Japanese Unexamined Patent Publication JP-A2008-31937 or Japanese Unexamined Patent Publication JP-A2001-220771.

Japanese Unexamined Patent Publication JP-A2008-31937 discloses an invention in which with respect to a motor, on one side in a horizontal direction orthogonal to a shaft center of an output shaft of the motor, a compressor is arranged, whereas on the other side, an alternator is arranged.

Japanese Unexamined Patent Publication JP-A2001-220771 discloses an invention in which on an upper side of a motor, an alternator and a compressor are arranged side by side in a shaft center direction of an output shaft of the motor, and also an invention in which on an upper side of a motor, an alternator and a compressor is arranged side by side in a horizontal direction orthogonal to a shaft center of the motor.

SUMMARY OF INVENTION

Technical Problem

In the case of a working machine in which an engine hood covering a motor mounted on a machine body is provided with an open/close cover that can open the inside of the engine hood backward, and by opening the open/close cover, the inside of the engine hood can be maintained, maintenance workability of a device arranged on a front side of the motor is poor.

In the case of, inside an engine hood provided with an open/close cover that can open the inside backward, transversely arranging the motor described in Japanese Unexamined Patent Publication JP-A2008-31937 such that the shaft center of the output shaft of the motor coincides with a lateral direction, any one of the compressor and the alternator is arranged on a front side of the motor, and therefore there arises a problem of poor maintenance workability of a device arranged on the front side.

Also, in the case of, inside an engine hood provided with an open/close cover that can open the inside backward, transversely arranging the motor described in Japanese Unexamined Patent Publication JP-A2001-220771 such that the shaft center of the output shaft of the motor coincides with a lateral direction, in the invention in which the alternator and the compressor are arranged side by side in the shaft center direction of the output shaft of the motor, longitudinal positions of the alternator and compressor with respect to the motor are not disclosed; however, in the case of, on a front side of the motor, arranging one or both of the alternator and the compressor, there arises a problem of poor maintenance workability of at least one device arranged on the front side of the motor. Also, in the invention in which the alternator and the compressor is arranged side by side in the horizontal direction orthogonal to the shaft center of the motor, any one of the compressor and the alternator is arranged on a front side of the motor, and therefore there arises a problem of poor maintenance workability of a device arranged on the front side.

Therefore, the present invention is, in consideration of such problems, intended to provide a working machine of which a compressor and an alternator are accessible from a back side of an engine hood.

Solution to Problem

Technical means taken by the present invention in order to solve the technical problems are characterized by the following respects.

A first aspect of the present invention is characterized in that: on a machine body, a motor is mounted such that a shaft center of an output shaft thereof coincides with a lateral direction; an engine hood covering the motor is provided with an open/close cover that can open an inside of the engine hood backward; on a lateral surface of the motor on an output shaft side, a compressor bracket attached with a compressor at a position behind the output shaft of the motor is attached and fixed; and an alternator that is positioned behind the output shaft of the motor and vertically displaced in position from the compressor is provided.

A second aspect of the present invention is characterized in that the compressor bracket is provided with an alternator stay to which the alternator is attached.

A third aspect of the present invention is characterized in that: the compressor bracket is provided with a tension pulley that provides tension to a compressor belt that transmits power of the motor to the compressor; and the compressor bracket is provided with a belt tension adjusting mechanism that makes an adjustment of the tension of the compressor belt from a back side of the engine hood, the tension being provided by the tension pulley.

A fourth aspect of the present invention is characterized in that: the alternator is arranged below and behind the compressor; a lower end side of the alternator is pivotally supported by an alternator bracket attached and fixed on the lateral surface of the motor on the output shaft side; an upper end side of the alternator is fixed to the alternator stay so as to be longitudinally movable around a pivotally supporting part on the lower end side of the alternator; and by swinging the alternator backward, tension is provided to an alternator belt that transmits power of the motor to the alternator.

Advantageous Effects of Invention

According to the present invention, the following effects are produced.

According to the first aspect of the present invention, the compressor bracket enables the compressor to be arranged behind the output shaft of the motor, and also by providing the alternator that is positioned behind the output shaft of the motor and vertically displaced from the compressor, the compressor and the alternator can be easily accessed from the back side of the engine hood to improve maintenance workability of the compressor and the alternator.

According to the second aspect of the present invention, by providing the compressor bracket with the alternator stay, positioning of the alternator with respect to the compressor can be easily performed, and the compressor and the alternator can be easily arranged with being positioned behind the output shaft of the motor and vertically displaced in position.

According to the third aspect of the present invention, the tension adjustment of the compressor belt can be made from the back side of the engine hood by the belt tension adjustment mechanism, and therefore maintenance workability is good.

Also, by providing the compressor bracket, which is attached with the compressor, with the tension pulley that provides the tension to the compressor belt, centering of the compressor belt is facilitated. Further, the compressor bracket is provided with the tension pulley and the belt tension adjusting mechanism, and therefore by attaching the compressor bracket, the tension pulley and the belt tension adjusting mechanism can be simultaneously attached to facilitate the attachment.

The fourth aspect of the present invention is configured such that the alternator is positioned below and behind the compressor, and by swinging the alternator backward around the pivotally supporting part on the lower end side of the alternator, the tension is provided to the alternator belt, so that at the time of making the tension adjustment of the alternator belt from the back side of the engine hood, the tension adjustment of the alternator belt can be easily made, and therefore the maintenance workability is good.

DESCRIPTION OF EMBODIMENTS

Figure 1:
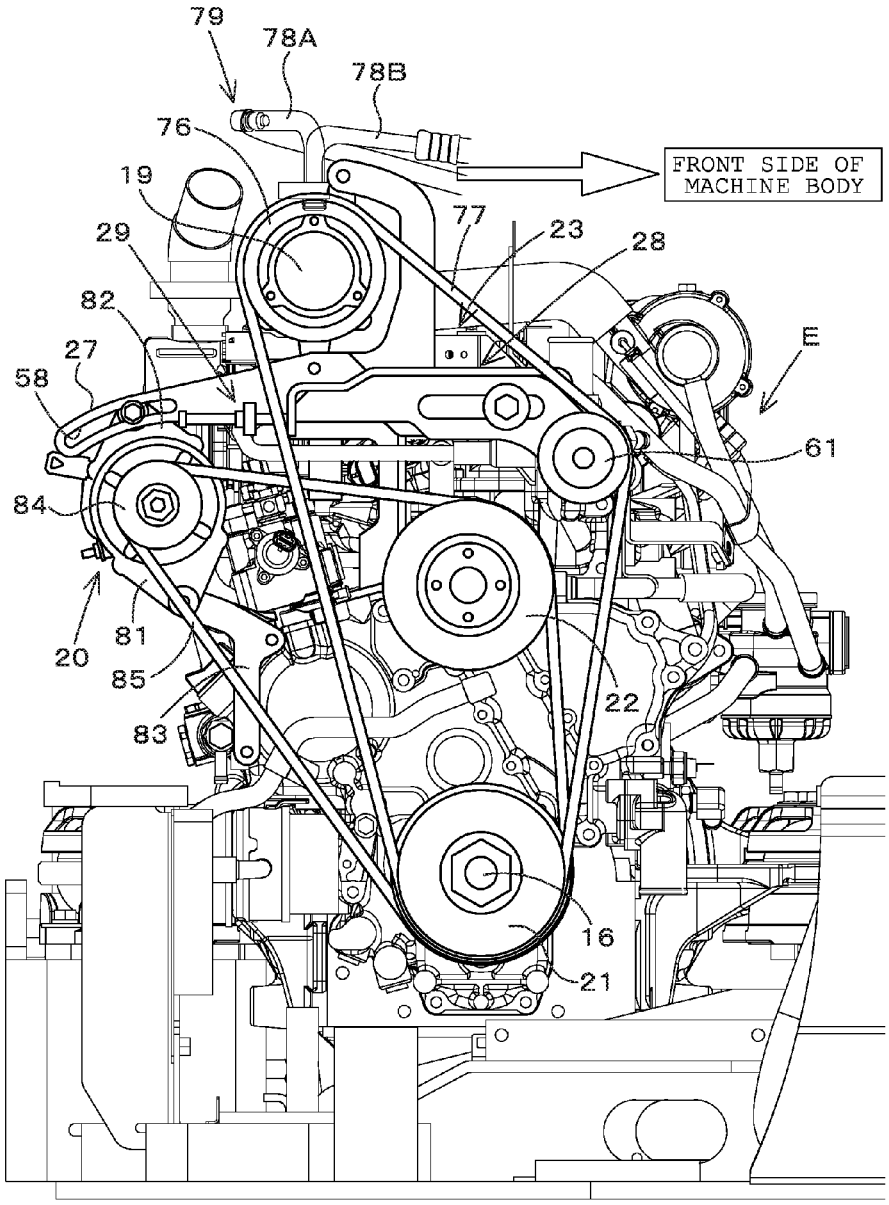
FIG. 1 is a side view of an output shaft side of an engine.

In the following, an embodiment of the present invention is described referring to the drawings.

Figure 12:
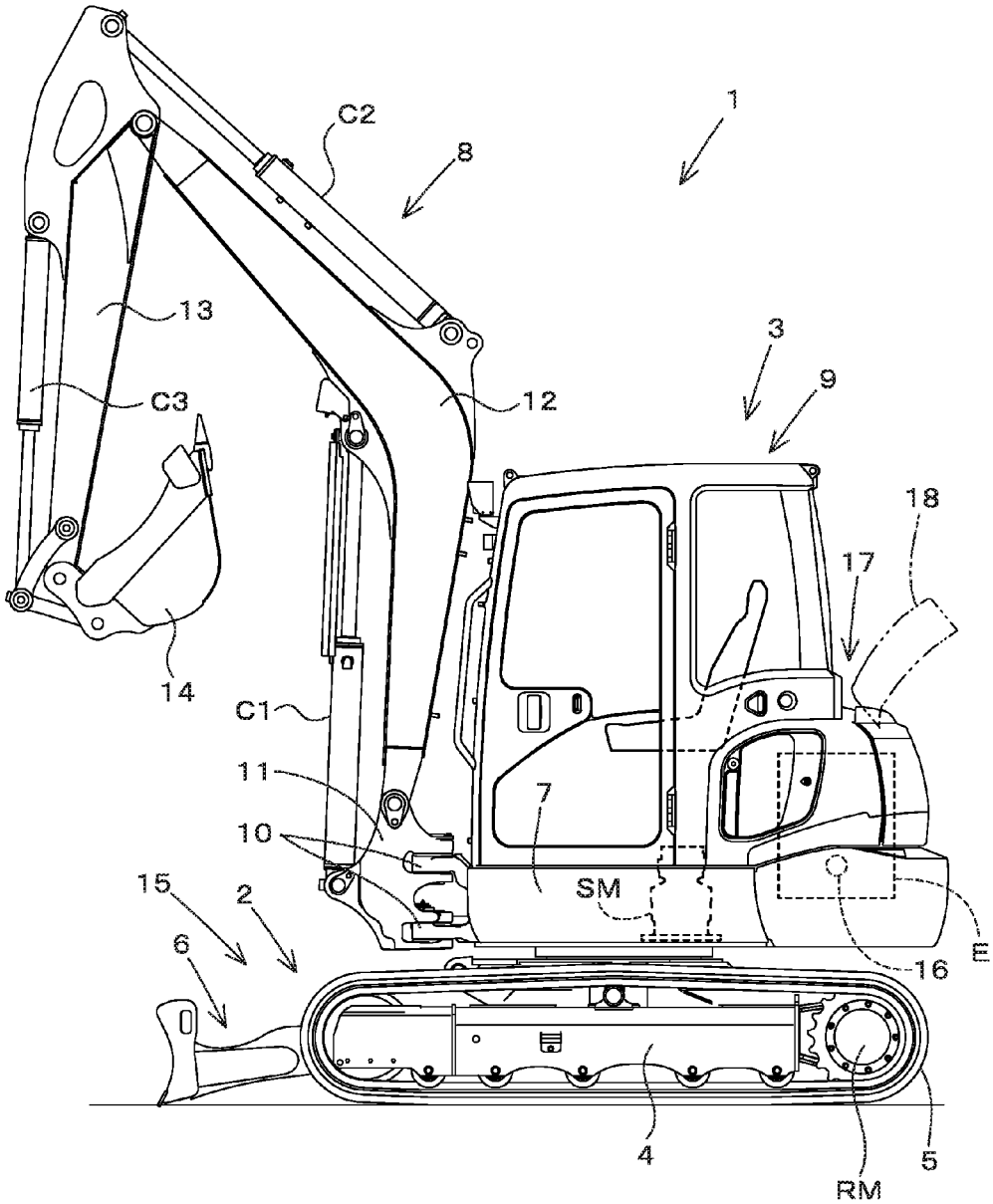
FIG. 12 is a side view of a working machine.

In FIG. 12, reference numeral 1 represents a backhoe that is exemplified as a working machine (revolving working machine).

The backhoe 1 is configured to mainly include: a lower traveling body 2; and an upper revolving body 3 that is mounted on the traveling body 2 so as to be revolvable around a vertical pivot center.

The traveling body 2 is, on both of left and right sides of a truck frame 4, respectively provided with crawler type traveling units 15 each configured to circulate and rotationally drive a crawler belt 5 in a circumferential direction by a traveling motor RM including a hydraulic motor.

On a front side of the truck frame 4, a dozer unit 6 is provided, and a blade of the dozer unit 6 is made movable up and down by expansion and contraction of a dozer cylinder including a hydraulic cylinder.

The revolving body 3 is provided with: a revolving base 7 that is mounted on the truck frame 4 so as to be revolvable (rotatable) around a pivot center and constitutes a machine body; a front operating unit (excavating unit) 8 that is equipped on a front side of the revolving base 7; and a cabin 9 that is mounted on the revolving base 7.

The revolving base 7 is provided with an engine E (motor), a radiator, a fuel tank, an operating oil tank, a battery, and the like, and made revolvably driven by a revolving motor SM (hydraulic actuator) including a hydraulic motor.

Also, on the front side of the revolving base 7, a swing bracket 11 that is supported swingably left and right around a vertical shaft center by support brackets 10 that are provided with protruding forward from the revolving base 7 is provided. The swing bracket 11 is made swingably operated left and right by expansion and contraction of a swing cylinder including a hydraulic cylinder.

The front operating unit 8 is configured to mainly include: a boom 12 that is made swingable up and down by a base part side that is pivotally connected to an upper part of the swing bracket 11 so as to be rotatable around a lateral shaft; an arm 13 that is made swingable back and forth by a base part side that is pivotally connected to a fore end side of the boom 12 so as to be rotatable around a lateral shaft; and a bucket 14 that is made swingable back and forth by being pivotally connected to a fore end side of the arm 13 so as to be rotatable around a lateral shaft.

The boom 12 performs an vertical operation by expanding and contracting a boom cylinder C1 that is set between the boom 12 and the swing bracket 11.

The arm 13 performs a swing operation by expanding and contracting an arm cylinder C2 that is set between the arm 13 and the boom 12.

The bucket 14 performs a swing operation by expanding and contracting a bucket cylinder C3 that is set between the bucket 14 and the arm 13.

As illustrated in FIG. 12, the engine E is mounted on a back part of the revolving base 7 with being transversely arranged such that a shaft center of an output shaft 16 thereof coincides with a lateral direction of the revolving base 7 (machine body). The engine E is covered by an engine hood 17, and the engine hood 17 is provided with an open/close cover 18 that can open the inside of the engine hood 17 (engine room) backward.

Figure 2:
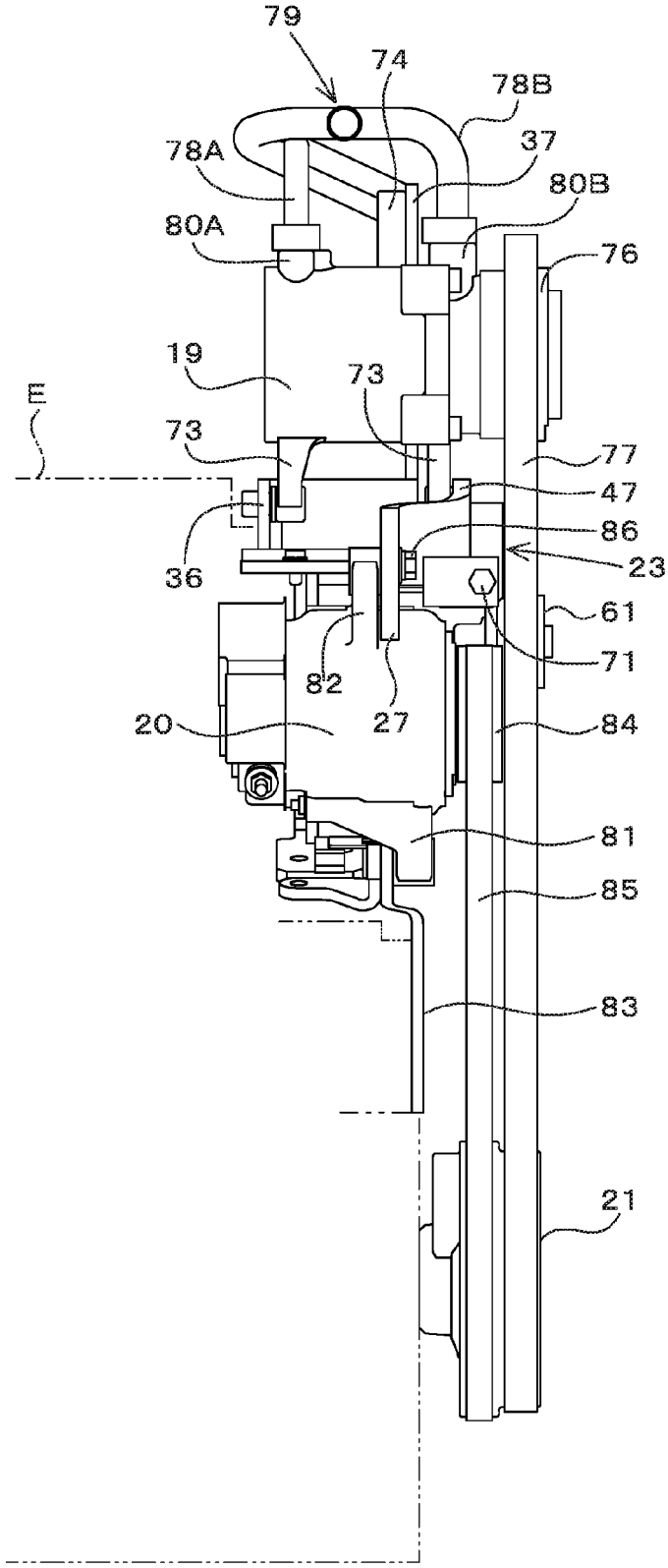
FIG. 2 is a back view of the output shaft side of the engine.

As illustrated in FIGS. 1 and 2, on a lateral side of the engine E on the output shaft 16 side (in the present embodiment, on a right lateral side of the engine E), a compressor 19 and an alternator 20 are arranged. The compressor 19 and alternator 20 are arranged on a back side of the output shaft 16 of the engine E, and also arranged with being vertically displaced in position.

In the present embodiment, the compressor 19 is positioned above the alternator 20. Also, the alternator 20 is positioned behind the compressor 19.

By, as described, arranging the compressor 19 and the alternator 20 behind the output shaft 16 of the engine E, and also arranging the compressor 19 and the alternator 20 with vertically displacing the compressor 19 and the alternator 20 from each other in position, the compressor 19 and the alternator 20 can be easily accessed from a back side (an opening part of the engine hood 17, which is formed by opening the open/close cover 18) of the engine hood 17 to improve maintenance workability of the compressor 19 and the alternator 20.

The compressor 19 is intended for an air conditioner, and one that is driven by power of the engine E to compress air conditioning gas (heating medium). The alternator 20 is one that is driven by the power of the engine E to output DC power, and can serve as a DC power supply and charge the battery.

The output shaft 16 of the engine E is positioned in a lower part of a central part in a longitudinal direction of the engine E, and an output pulley 21 is attached to the output shaft 16 so as to be integrally rotatable. The output pulley 21 has a left and right pair of belt grooves around which belts are wound.

Above the output pulley 21, a fan pulley 22 for driving a cooling fan that cools the radiator and the like is provided.

Also, on a lateral surface of the engine E on the output shaft 16 side, a compressor bracket 23 attached with the compressor 19 is attached.

Figure 4:
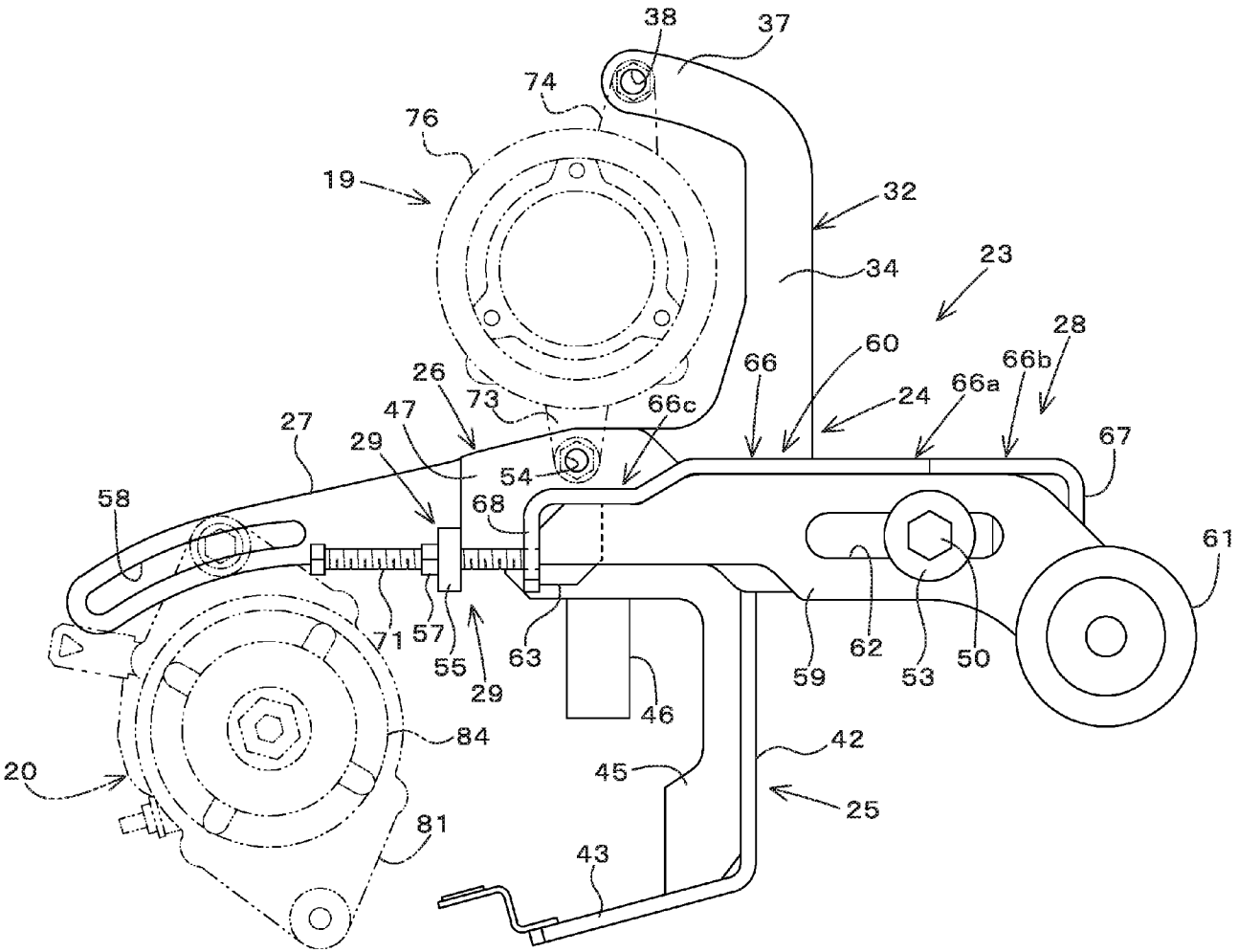
FIG. 4 is a side view of the compressor bracket.
Figure 5:
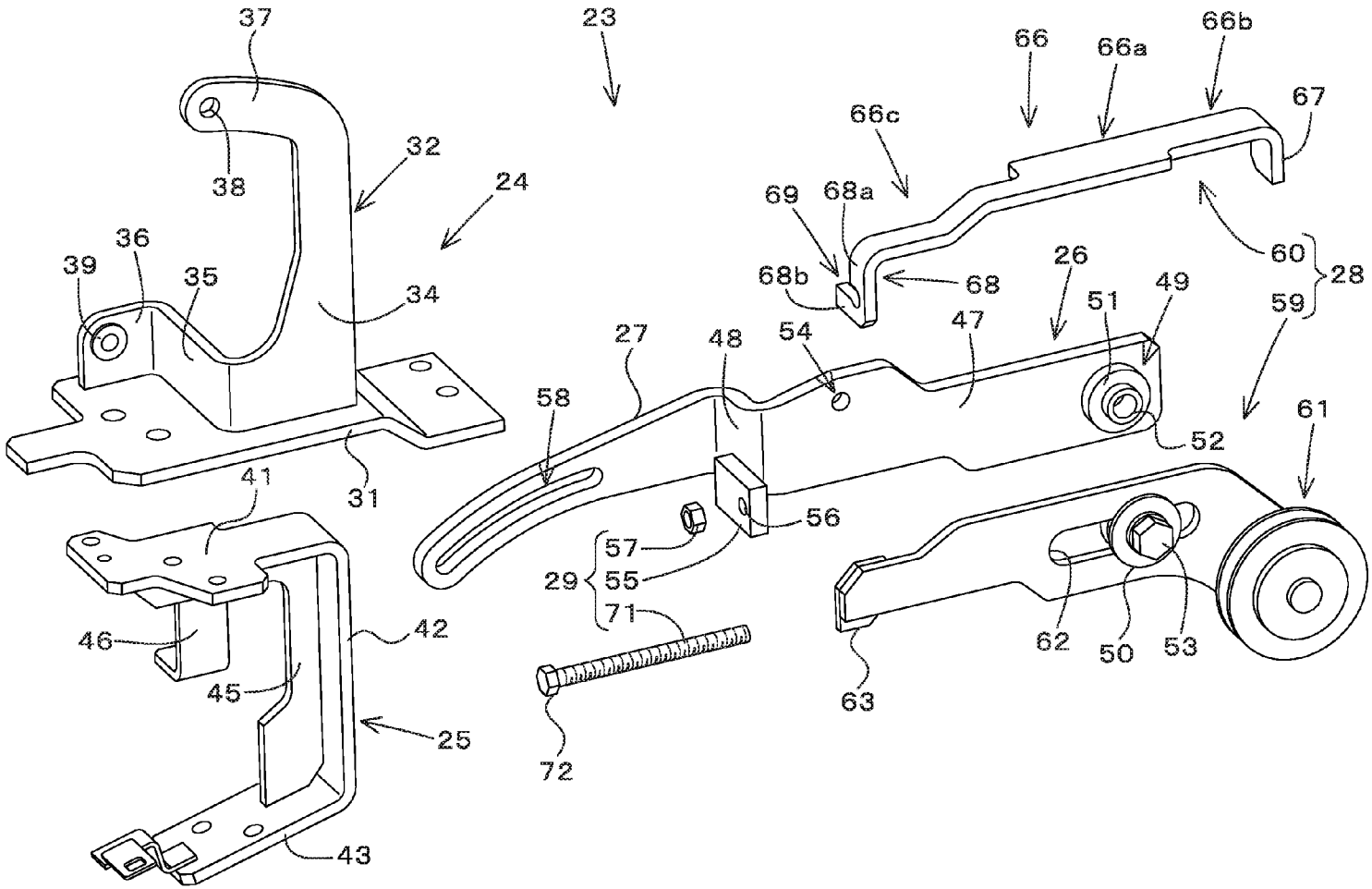
FIG. 5 is an exploded perspective view of the compressor bracket.

As illustrated in FIGS. 4 and 5, the compressor bracket 23 has a main bracket 24, a support bracket 25, a pulley supporting bracket 26, an alternator stay 27, a pulley stay 28, and a belt tension adjusting mechanism 29.

The main bracket 24 has: a base plate 31 that is arranged such that a plate face thereof faces in a vertical direction; and an attaching plate 32 that is provided upright on the base plate 31.

Figure 3:
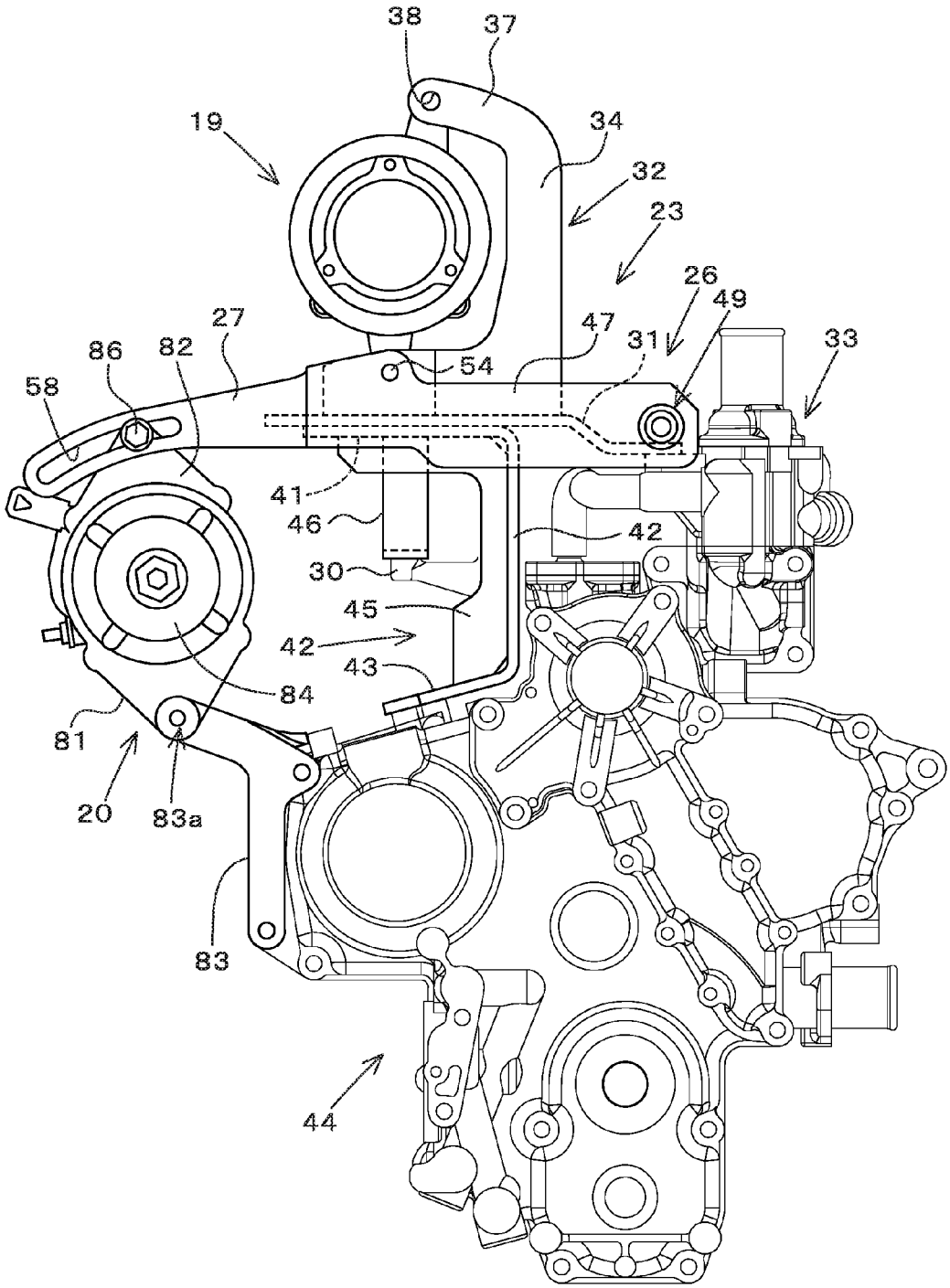
FIG. 3 is a side view illustrating an attached state of a compressor bracket.

As illustrated in FIG. 3, a front part of the base plate 31 is fixed to a water flange 33 with a bolt.

Figure 6:
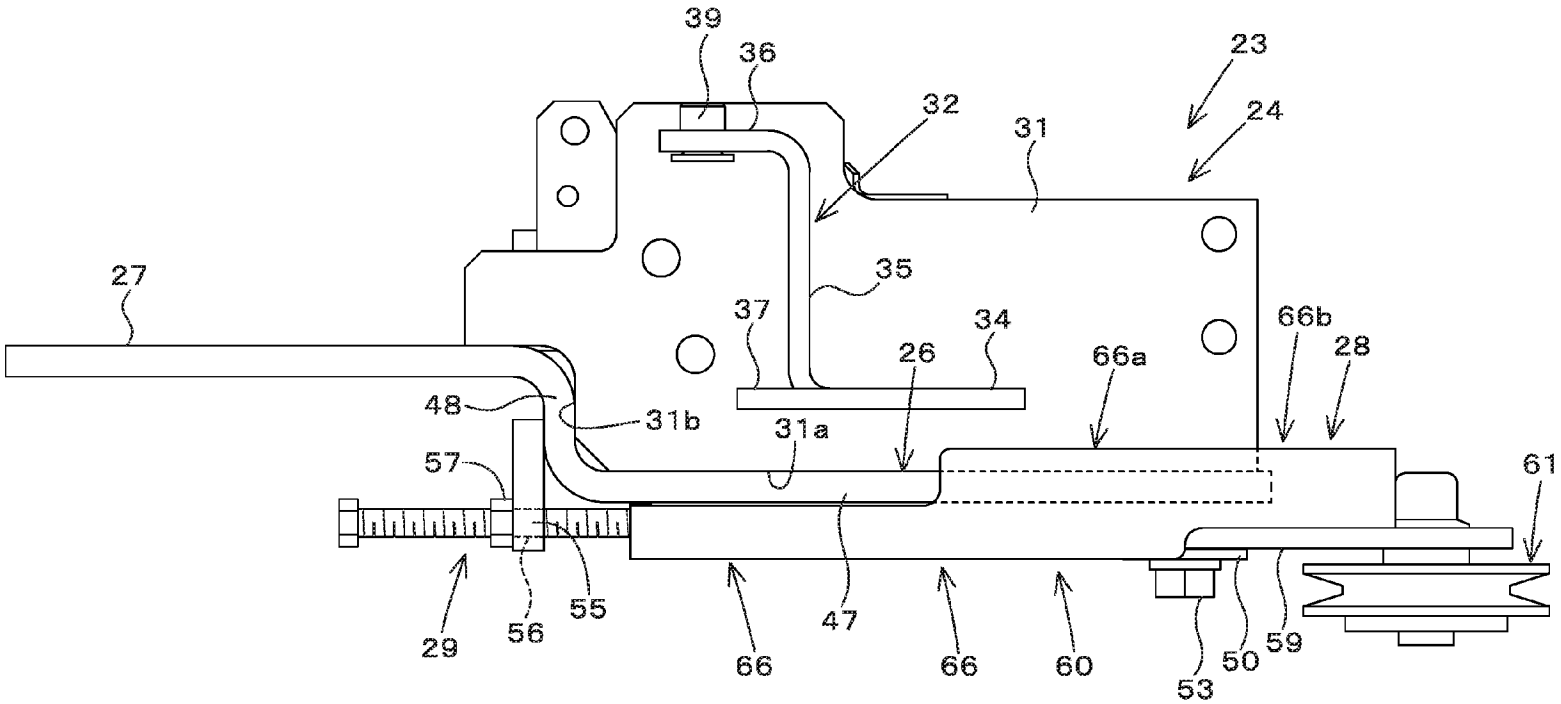
FIG. 6 is a plan view of the compressor bracket.

The attaching plate 32 is, as illustrated in drawings such as FIGS. 5 and 6, configured to mainly include: a main wall 34 that extends upward from a right lateral part on the base plate 31; an extension wall 35 that extends from a lower back end of the main wall 34 toward a left side; and a lower attaching wall 36 that extends backward from a left end of the extension wall 35.

An upper part of the main wall 34 is adapted to be an upper attaching part 37 formed in a shape extending backward, and on a back end side of the upper attaching part 37, a bolt insertion hole 38 into which a bolt for attaching an upper part of the compressor 19 is inserted is formed.

The lower attaching wall 36 is provided with a collar 39 into which a bolt for attaching a lower part of the compressor 19 is inserted.

Figure 8:
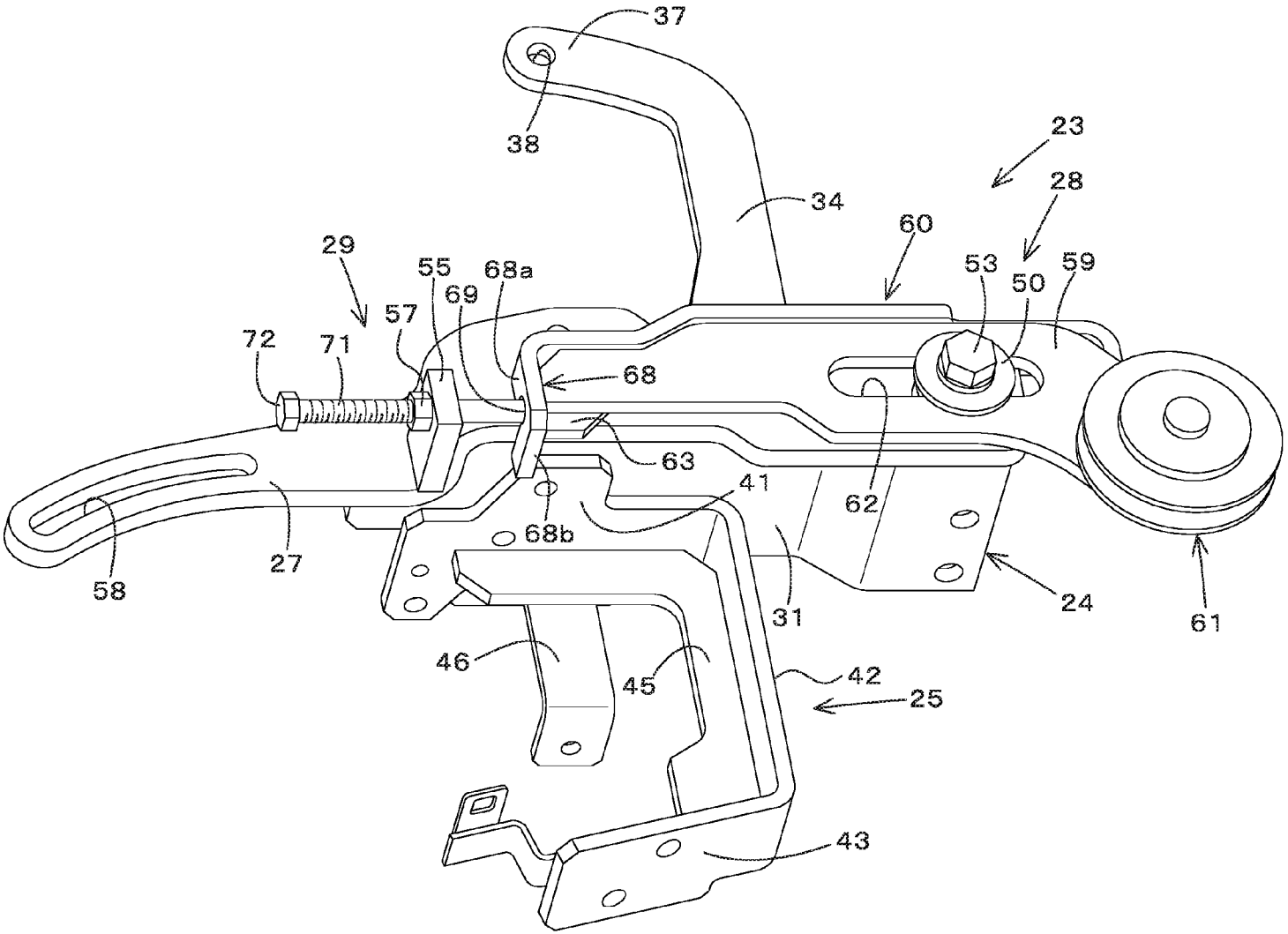
FIG. 8 is a perspective view of the compressor bracket as viewed from obliquely backward lower right.

As illustrated in drawings such as FIGS. 5 and 8, the support bracket 25 includes: an upper wall 41 that is fixed on a lower surface of the base plate 31 with bolts; a front wall 42 that extends downward from a front end of the upper wall 41; and a lower wall 43 that extends backward and obliquely downward from a lower end of the front wall 42.

The lower wall 43 of the support bracket 25 is, as illustrated in FIG. 3, fixed with a bolt to a gear case 44 that is provided on a right side of the engine E.

The support bracket 25 is, as illustrated in drawings such as FIG. 8, provided with a reinforcing plate 45 between the upper wall 41 and the lower wall 43.

Figure 10:
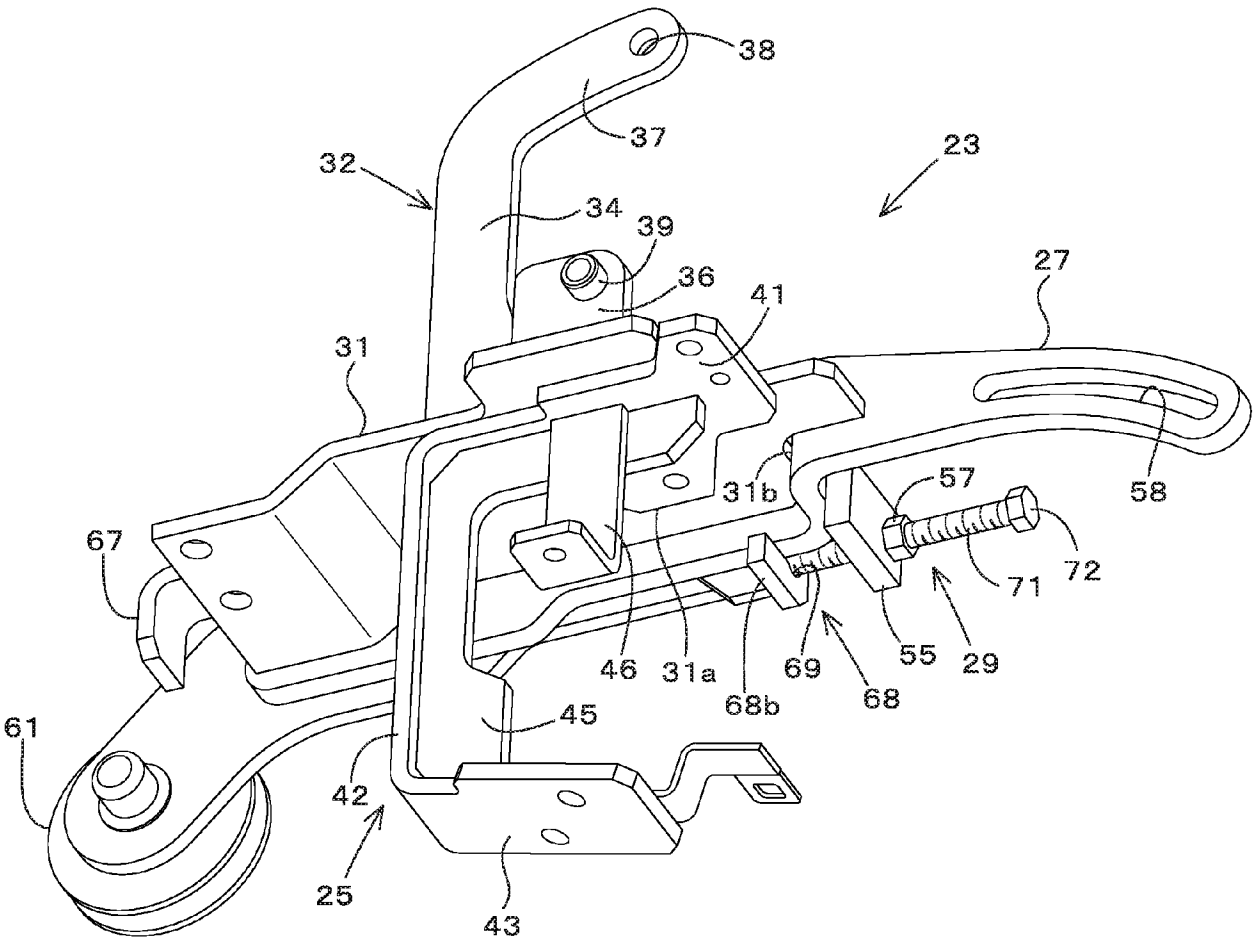
FIG. 10 is a perspective view of the compressor bracket as viewed from obliquely forward lower left.

Also, on a left side of a lower surface of the upper wall 41 of the support bracket 25, as illustrated in drawings such as FIG. 10, an upper end side of a support stay 46 is welded and fixed, and a lower end side of the support stay 46 is, as illustrated in FIG. 3, fixed with a bolt to a stay attaching part 30 provided on the engine E.

Figure 11:
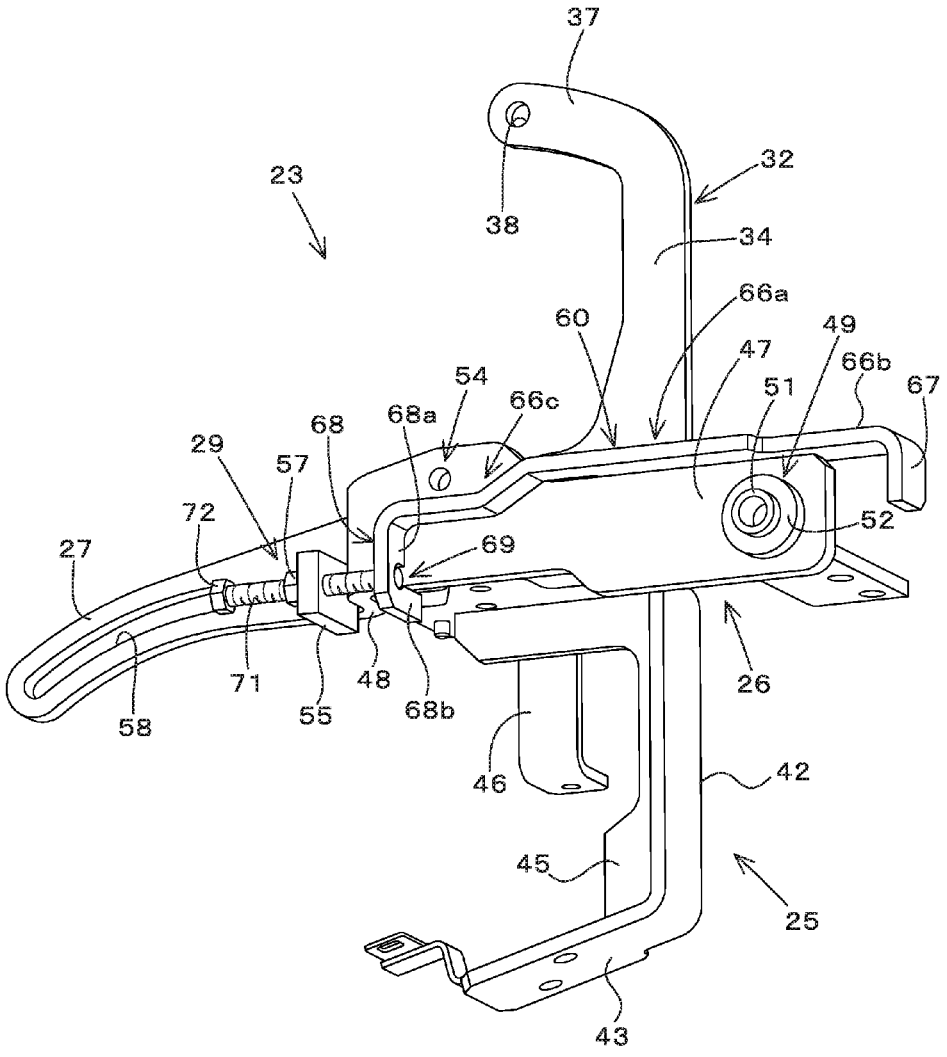
FIG. 11 is a perspective view of the compressor bracket as viewed from obliquely forward right.

As illustrated in FIGS. 5 and 11, the pulley supporting bracket 26 is arranged such that a plate face thereof faces in the lateral direction, and has a longitudinally long supporting wall 47, and an extending wall 48 that extends leftward from a back end of the supporting wall 47.

Figure 9:
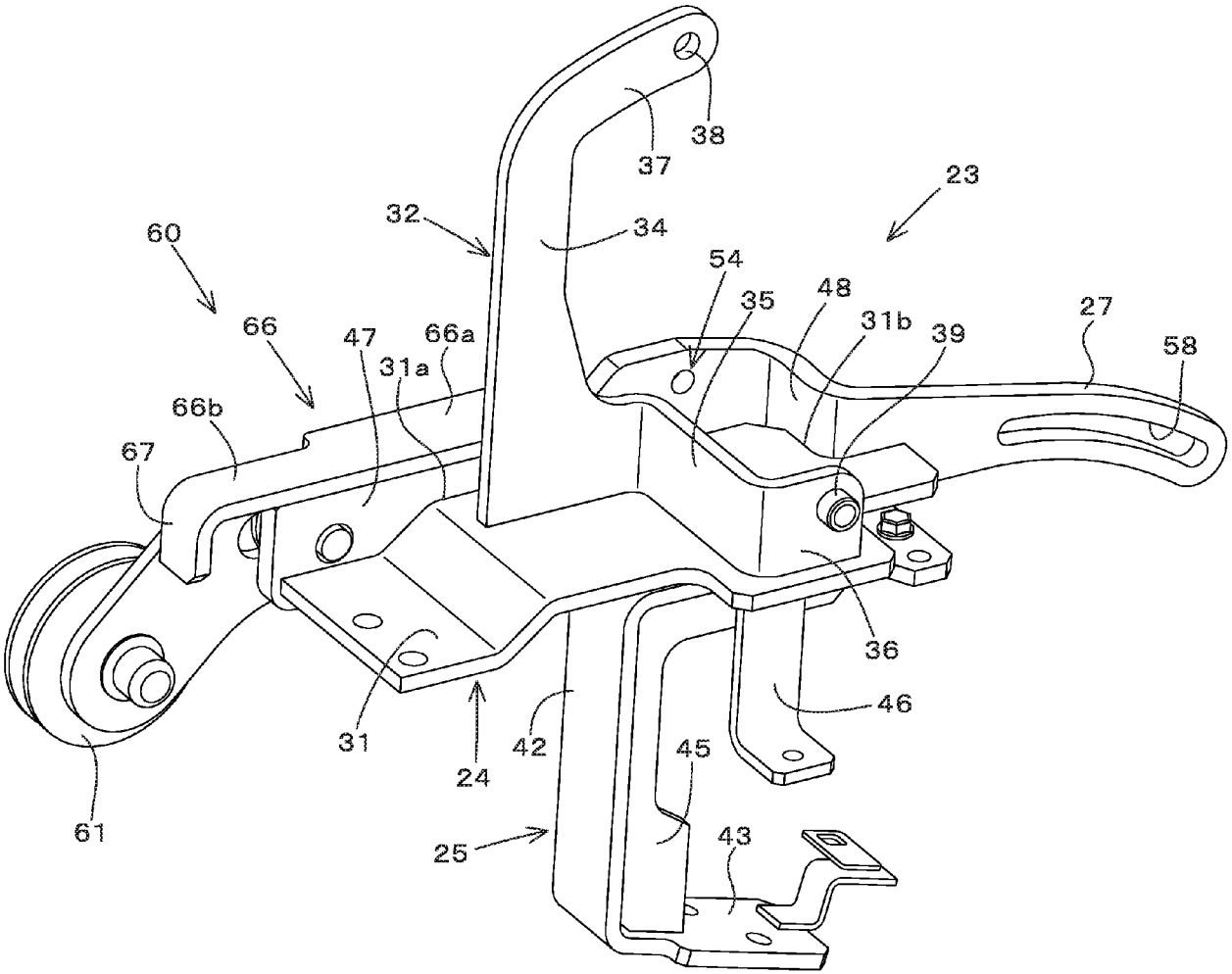
FIG. 9 is a perspective view of the compressor bracket as viewed from obliquely forward upper left.

As illustrated in FIGS. 6 and 9, the supporting wall 47 is welded and fixed to a right end 31*a* of the base plate 31, and the extending wall 48 is welded and fixed to a back end 31*b* of the right lateral part of the base plate 31.

As illustrated in FIGS. 5 and 11, on a front end side of a right lateral surface of the supporting wall 47 of the pulley supporting bracket 26, a guide collar 49 is provided. The guide collar 49 is formed of: a large diameter part 51 that is fixed on the supporting wall 47; and a small diameter part 52 that protrudes rightward from the large diameter part 51.

In an upper part of a back part of the supporting wall 47, a bolt insertion hole 54 into which a bolt for attaching the lower part of the compressor 19 is inserted is formed. The bolt insertion hole 54 is formed laterally concentrically with an inner hole of the collar 39 provided in the lower attaching wall 36 of the attaching plate 32 of the main bracket 24.

As illustrated in FIGS. 5 and 6, in a back surface lower part of the extending wall 48 of the pulley supporting bracket 26, a fixing piece 55 arranged such that a plate face thereof faces in the longitudinal direction is welded and fixed; the fixing piece 55 is arranged in a shape protruding rightward from the extending wall 48; and in a protruding portion of the fixing piece 55, a screw hole 56 is formed with longitudinally penetrating. On a back surface of the fixing piece 55, a locknut 57 positioned on a back side of the screw hole 56 is arranged.

As illustrated in FIG. 5, the alternator stay 27 is extended backward integrally from a left end of the extending wall 48 of the pulley supporting bracket 26 (the pulley supporting bracket 26 and the alternator stay 27 are formed of one sheet of plate material). The alternator stay 27 is formed with a guide groove 58 for attaching the alternator 20, and the guide groove 58 is formed in a longitudinally long arc shape.

As illustrated in FIG. 5, the pulley stay 28 has a main plate 59 and a regulation plate 60.

The main plate 59 is arranged such that a plate face thereof faces in the lateral direction, and arranged in parallel with a right side of the supporting wall 47 of the pulley supporting bracket 26. On a front end side of the main plate 59, a tension pulley 61 is attached rotatably around a lateral shaft. Also, in a front part of the main plate 59 and on aback side of the tension pulley 61, a longitudinally long guide hole 62 is formed. The guide hole 62 is longitudinally movably fitted to the small diameter part 52 of the guide collar 49 at the outside of the small diameter part 52.

On a right side of the guide hole 62, a washer 50 is arranged, and a retaining bolt 53 that is inserted into the washer 50 and guide hole 62 from a right side and also inserted into the guide collar 49, and a nut into which the bolt is screwed regulate a rightward movement of the pulley stay 28.

On a back end side of a left lateral surface of the main plate 59, a bolt touching plate 63 is welded and fixed.

As illustrated in FIGS. 5 and 6, the regulation plate 60 of the pulley stay 28 includes: a main wall part 66 of which a plate face faces in the vertical direction; a front wall part 67 that is extended downward from a front end of the main wall part 66, and a back wall part 68 that is extended downward from a back end of the main wall part 66.

A right side of a longitudinally middle part 66*a* of the main wall part 66 is welded and fixed to an upper end of the main plate 59 with being superimposed on the upper end. A left side of the middle part 66*a* longitudinally movably comes into sliding contact with an upper end of the supporting wall 47 of the pulley supporting bracket 26 to thereby regulate a downward movement of the pulley stay 28.

A front part 66*b* of the main wall part 66 is extended forward from the left side of the middle part 66*a*, and longitudinally movably comes into sliding contact with the upper end of the supporting wall 47 of the pulley supporting bracket 26. This also causes the downward movement of the pulley stay 28 to be regulated.

Figure 7:
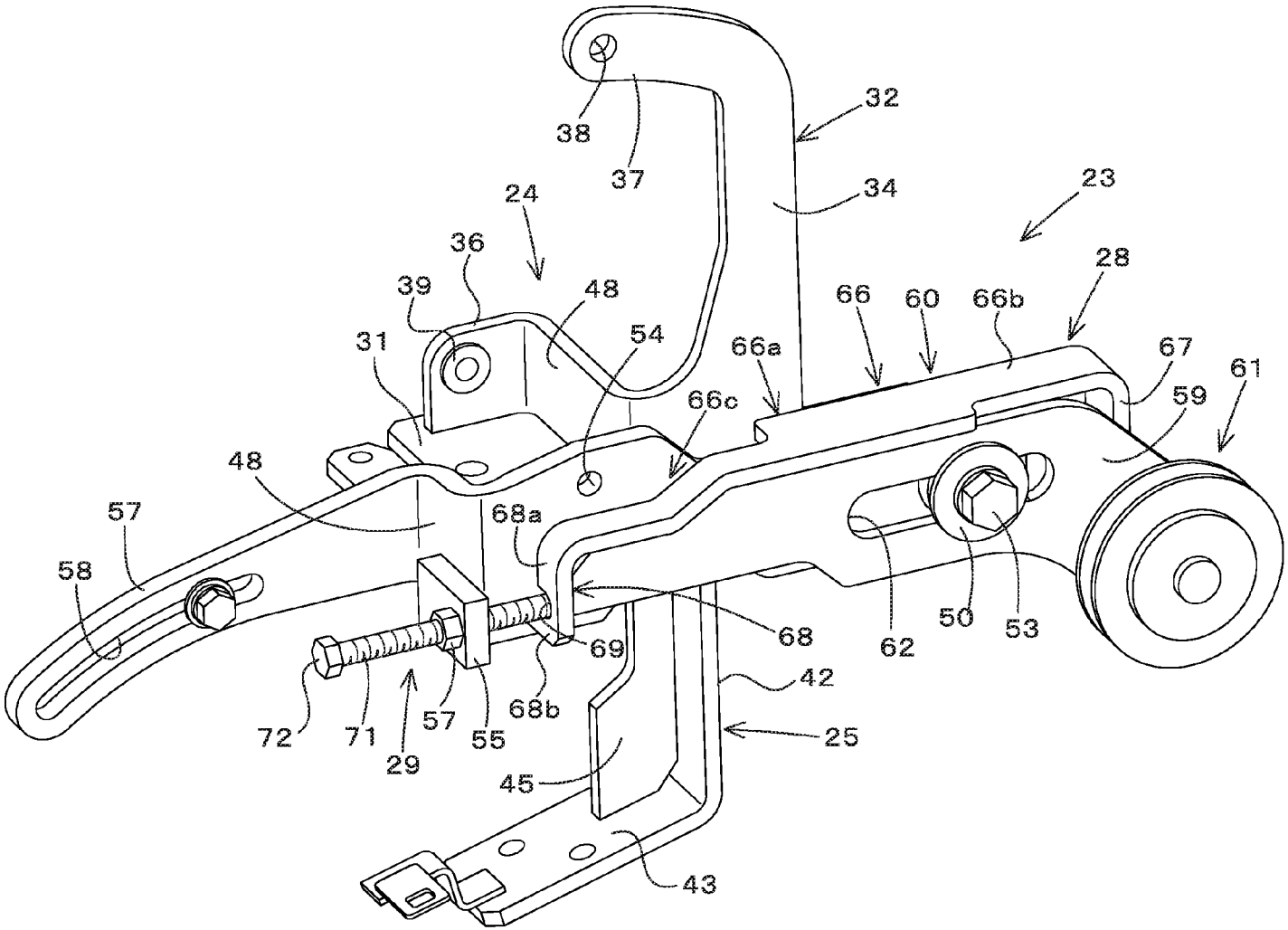
FIG. 7 is a perspective view of the compressor bracket as viewed from obliquely backward upper right.

A back part 66*c* of the main wall part 66 is, as illustrated in FIGS. 4 and 7, extended backward from the right side of the middle part 66*a* of the main wall part 66; front and back side parts thereof are horizontal; and a middle part thereof is formed in a tilted shape that is tilted downward toward a back side.

A back side part of the back part 66*c* of the main wall part 66 is positioned on a lower side of the bolt insertion hole 54.

The back part 66*c* of the main wall part 66 is welded and fixed to the upper end of the main plate 59, and the back part 66*c* of the main wall part 66 is adapted to be longitudinally movably touchable with the right lateral surface of the supporting wall 47 of the pulley supporting bracket 26. This causes a leftward movement of the pulley stay 28 to be regulated.

A lower end side of the front wall part 67 of the regulation plate 60 is welded and fixed to a left lateral surface of the front part of the main plate 59.

As illustrated in FIG. 7, an upper part 68*a* of the back wall part 68 of the regulation plate 60 is longitudinally movably touchable with a right lateral surface of the main plate 59, which also causes the leftward movement of the pulley stay 28 to be regulated.

As illustrated in FIG. 10, a lower part 68*b* of the back wall part 68 of the regulation plate 60 is formed larger in lateral width than the upper part, and longitudinally movably comes into sliding contact with a lower end of the supporting wall 47 of the pulley supporting bracket 26. This causes an upward movement of the pulley stay 28 to be regulated.

As described above, the respective parts of the regulation plate 60 touch the supporting wall 47 of the pulley supporting bracket 26, and thereby the pulley stay 28 is made longitudinally slidable without backlash with respect to the pulley supporting bracket 26.

Also, as illustrated in FIGS. 5 and 7, the upper part of the back wall part 68 of the regulation plate 60 is formed with a cutout groove 69 that is formed by being cut out from a left end to right.

The belt tension adjusting mechanism 29 is, as illustrated in FIG. 5, configured to include the fixing piece 55, the locknut 57, and an adjusting bolt 71.

The adjusting bolt 71 is, as illustrated in FIG. 4, screwed into the locknut 57 from a back side as well as being screwed into the screw hole 56 of the fixing piece 55, and inserted into the cutout groove 69, and a fore end (front end side) thereof touches a back end of the main plate 59 of the pulley stay 28 and a back end of the bolt touching plate 63.

A head part 72 of the adjusting bolt 71 can be rotationally operated from a back side of the engine hood 17.

As illustrated in FIGS. 2 and 4, the compressor 19 is arranged above a back part of the base plate 31 of the main bracket 24; in a lower part thereof, provided with a left and right pair of lower attached parts 73; and in an upper part thereof, provided with one upper attached part 74.

As illustrated in FIGS. 2 and 4, a right side lower attached part 73 is fixed to the upper part of the back part of the supporting wall 47 of the pulley supporting bracket 26 through a bolt; a left side lower attached part 73 is fixed to the lower attaching wall 36 of the attaching plate 32 of the main bracket 24 through a bolt; and the upper attached part 74 is fixed to the upper attaching part 37 of the attaching plate 32 of the main bracket 24 through a bolt.

As illustrated in FIG. 1, by attaching the compressor bracket 23 to the engine E with attaching the compressor 19 to the compressor bracket 23, the compressor 19 is arranged behind the output shaft 16 and above the alternator 20, and therefore the compressor can be easily positioned.

On a right side of the compressor 19, an input pulley 76 is provided; over the input pulley 76, the tension pulley 61, and the laterally outer (right) belt groove of the output pulley 21, a compressor belt 77 is wound; and the power is transmitted from the output shaft 16 of the engine E to the compressor 19 through the compressor belt 77 to drive the compressor 19.

A tension adjustment of the compressor belt 77 is made by rotating the head part 72 of the adjusting bolt 71 of the belt tension adjusting mechanism 29 from the back side of the engine hood 17. That is, in the case of, with setting back the locknut 57, rotating the head part 72 of the adjusting bolt 71 in a tightening direction, the adjusting bolt 71 screws forward with respect to the screw hole 56 of the fixing piece 55, and the fore end of the adjusting bolt 71 presses the main plate 59 of the pulley stay 28 and the bolt touching plate 63. This causes the pulley stay 28 to move forward to press the compressor belt 77 in a tensioning direction. After the tension adjustment has been made, the locknut 57 is tightened to fix the adjusting bolt 71.

In the case of loosening the compressor belt 77, by loosening the locknut 57 and rotating the head part 72 of the adjusting bolt 71 in a loosening direction, the adjusting bolt 71 screws backward with respect to the screw hole 56 of the fixing piece 55. In doing so, the tension pulley 61 and the pulley stay 28 is pressed by the compressor belt 77 to move backward, and thereby the compressor belt 77 is loosened.

By providing the compressor bracket 23, which is attached with the compressor 19, with the tension pulley 61 that provides tension to the compressor belt 77, centering of the compressor belt 77 (lateral positioning between a belt groove of the input pulley 76 of the compressor 19 and a belt groove of the tension pulley 61) can be easily performed.

As illustrated in FIGS. 1 and 2, on an upper surface side of the compressor 19, a left and right pair of connecting parts 80A and 80B connected with air conditioning pipes 78A and 78B for circulating the air conditioning gas is provided, and the left side connecting part 80A is connected with the high pressure side (High side) air conditioning pipe 78A, whereas the right side connecting part 80B is connected with the low pressure side (Low side) air conditioning pipe 78B. The low pressure side air conditioning pipe 78B is provided with a charge port 79 for charging the air conditioning gas; the charge port 79 is positioned above a back part of the compressor 19 and also provided so as to face backward; and thereby the air conditioning gas can be easily charged from the back side of the engine hood 17, As illustrated in FIGS. 2 and 3, the alternator 20 vertically has attached parts 81 and 82, and the lower attached part 81 is pivotally supported by a alternator bracket 83 that is fixed to the gear case 44 of the engine E with a bolt. The upper attached part 82 is attached and fixed to the alternator stay 27 through a bolt 86 that is inserted into the guide groove 58 of the alternator stay 27. The guide groove 58 of the alternator stay 27 is formed in the arc shape centering around a pivotally supporting part 83*a* of the alternator bracket 83, which pivotally supports the lower attached part 81 of the alternator 20, and by loosening the bolt that fixes the upper attached part 82 of the alternator 20, the alternator 20 can be swung back and forth.

On a right side of the alternator 20, an input pulley 84 is provided, and the input pulley 84 is, as illustrated in FIG. 2, provided so as to be displaced to the left with respect to the input pulley 76 of the compressor 19.

As illustrated in FIG. 1, over the input pulley 84, the fan pulley 22, and the laterally inner (left) belt groove of the output pulley 21, an alternator belt 85 is wound, and the power is transmitted from the output shaft 16 of the engine E to the alternator 20 through the alternator belt 85 to drive the alternator 20.

The alternator belt 85 is positioned to the left of the compressor belt 77.

A tension adjustment of the alternator belt 85 is made by loosening the bolt 86, which fixes the upper attached part 82 of the alternator 20, to swing the alternator 20 backward, and this tension adjustment is also easily made from the back side of the engine hood 17.

By integrating the alternator stay 27 with the compressor bracket 23, the number of parts can be reduced.

Also, by making the compressor bracket 23 have a function of staying the alternator 20, a relative lateral position between the input pulley 76 of the compressor 19 and the input pulley 84 of the alternator 20 can be determined by the compressor bracket 23, and therefore at the time of assembling the compressor 19 and the alternator 20, as compared with the case of assembling the compressor 19 and the alternator 20 with separate brackets, positioning of the input pulley 84 of the alternator 20 with respect to the input pulley 76 of the compressor 19 can be easily performed to facilitate the assembling.

Figure 13:
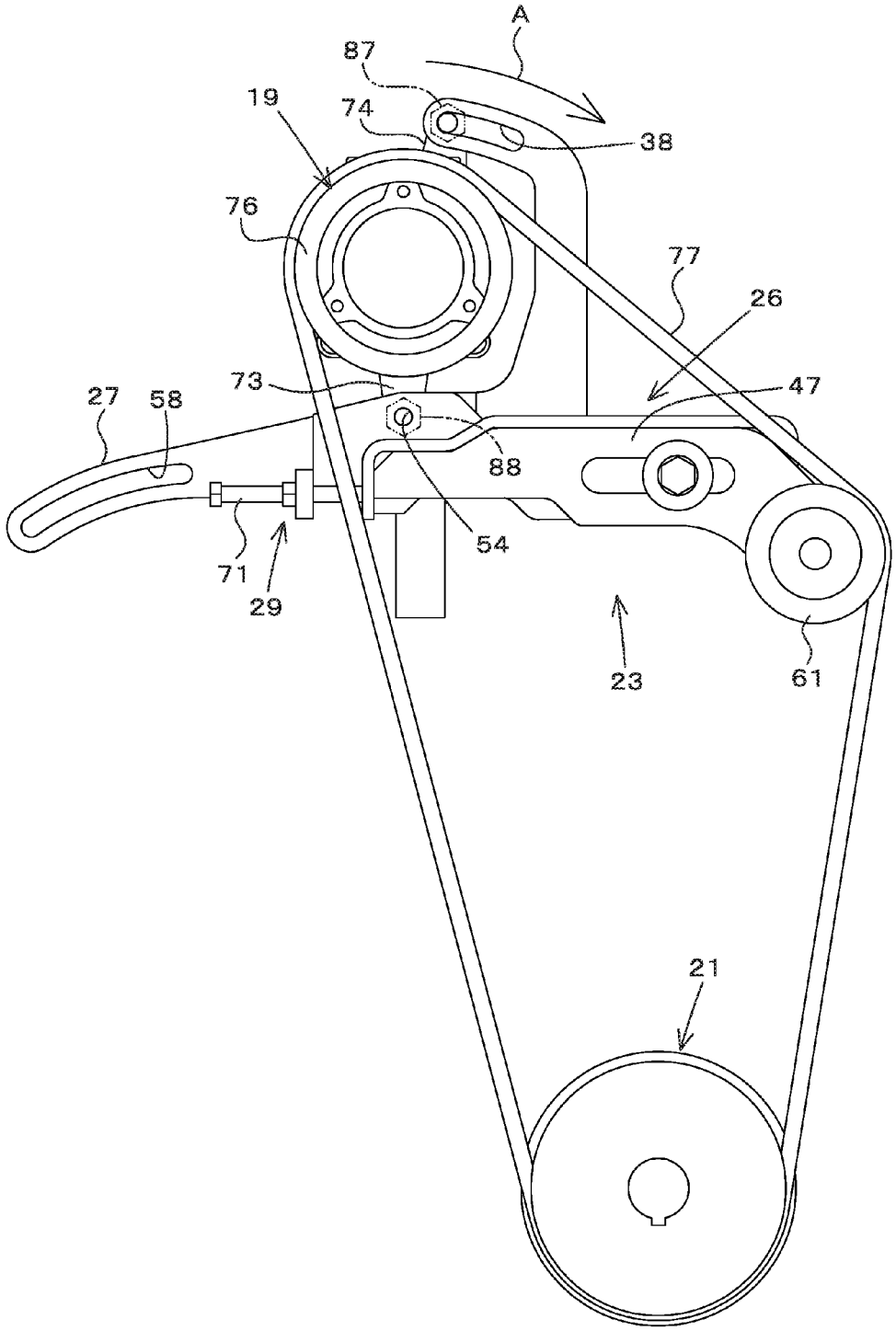
FIG. 13 is a side view illustrating another embodiment of the compressor bracket.

FIG. 13 illustrates another embodiment, in which a bolt insertion hole 38 into which a bolt 87 that fixes an upper attached part 74 of a compressor 19 is inserted is formed in an arc shape centering around a bolt insertion hole 54 formed in a supporting wall 47 of a pulley supporting bracket 26.

In the present embodiment, to replace a compressor belt 77, by loosening the bolts 87 and 88 that respectively fix the upper attached part 74 and lower attached part 73 of the compressor 19, and swinging an upper part of the compressor 19 forward (in FIG. 13, in a direction indicated by an arrow A), tension of the compressor belt 77 is released. In this state, the compressor belt 77 is replaced, and then the upper part of the compressor 19 is swung backward (in a direction opposite to the direction indicated by the arrow A) to tighten the bolts for fixing the upper attached part 74 and lower attached part 73 of the compressor 19. This causes the compressor belt 77 to come into a tensioned state. In the case where the tension of the compressor 19 is low, by rotating an adjusting bolt 71 in a tightening direction, the tension is adjusted.

The belt tension adjusting mechanism 29 may be employed for tension adjustment of the alternator belt 85. Further, the belt tension adjusting mechanism can also be applied to a location where other belt tension adjustment is required.

Also, as the motor, an electric motor may be employed in place of the engine.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The text of Japanese application No. 2012-174122 filed on Aug. 6, 2012 is hereby incorporated by reference.

The invention claimed is:

1. A working machine wherein:

a motor mounted on a machine body such that a shaft center of an output shaft thereof coincides with a lateral direction of the machine body;

an engine hood covering the motor is provided with an open/close cover that can open an inside of the engine hood backward;

a compressor bracket attached on a lateral surface of the motor on an output shaft side, with a compressor at a position behind the output shaft of the motor is attached and fixed; and an alternator positioned behind the output shaft of the motor and vertically displaced in position from the compressor, wherein the compressor bracket is provided with a tension pulley that provides tension to a compressor belt that transmits power of the motor to the compressor, and wherein the compressor bracket is provided with a belt tension adjusting mechanism that makes an adjustment of the tension of the compressor belt from a back side of the engine hood, the tension being provided by the tension pulley.

2. The working machine according to claim 1, wherein the compressor bracket is provided with an alternator stay to which the alternator is attached.

3. A working machine wherein:

a motor mounted on a machine body such that a shaft center of an output shaft thereof coincides with a lateral direction of the machine body;

an engine hood covering the motor is provided with an open/close cover that can open an inside of the engine hood backward;

a compressor bracket attached on a lateral surface of the motor on an output shaft side, with a compressor at a position behind the output shaft of the motor is attached and fixed; and an alternator positioned behind the output shaft of the motor and vertically displaced in position from the compressor, wherein the compressor bracket is provided with an alternator stay to which the alternator is attached, wherein the alternator is arranged below and behind the compressor, wherein a lower end side of the alternator is pivotally supported by an alternator bracket attached and fixed on the lateral surface of the motor on the output shaft side, wherein an upper end side of the alternator is fixed to the alternator stay so as to be longitudinally movable around a pivotally supporting part on the lower end side of the alternator, and wherein by swinging the alternator backward, tension is provided to an alternator belt that transmits power of the motor to the alternator.

4. A working machine, comprising:

a motor mounted on a machine body such that a shaft center of an output shaft thereof coincides with a lateral direction of the machine body;

an engine hood covering the motor is provided with an open/close cover that can open an inside of the engine hood backward;

a compressor bracket attached on a lateral surface of the motor on an output shaft side, with a compressor at a position behind the output shaft of the motor is attached and fixed;

an alternator positioned behind the output shaft of the motor and vertically displaced in position from the compressor;

the output shaft is provided in a lower part of the engine;

above an output pulley integrally rotatably attached to the output shaft, a fan pulley is arranged;

on a back side and an upper side of the fan pulley, the compressor is arranged, and also on a back side and a lower side of the compressor, the alternator is arranged;

on a front side of the fan pulley, a tension pulley is arranged;

the compressor and the alternator are respectively provided with input pulleys; and over the output pulley, the fan pulley, and the input pulley of the alternator, an alternator belt is wound, and also over the output pulley, the tension pulley, and the input pulley of the compressor, a compressor belt is wound.

5. The working machine according to claim 1, wherein:

the compressor bracket has a longitudinally slidably supported pulley stay, a front part of the pulley stay is rotatably provided with the tension pulley, and by moving the pulley stay forward, the tension pulley can press the compressor belt in a tensioning direction; and the belt tension adjusting mechanism has an adjusting bolt arranged behind the pulley stay, the adjusting bolt is supported by the compressor bracket so as to be longitudinally screwable forward and backward, and can be rotatably operated from the back side of the engine hood, and by screwing the adjusting bolt forward, the pulley stay can be moved forward.

6. The working machine according to claim 1, wherein the machine body is mounted on the traveling body so as to be revolvable around a vertical pivot center, on a front side of the machine body, a front operating unit having a boom, an arm, and a bucket is equipped, and on a back part of the machine body, the motor is mounted.

* * * * *